US007771641B2

(12) United States Patent
Salameh et al.

(10) Patent No.: US 7,771,641 B2
(45) Date of Patent: Aug. 10, 2010

(54) COMPONENT PART WITH INTEGRATED SEAL

(75) Inventors: Ralf Salameh, Gondelsheim (DE); Timo Walz, Gondelsheim (DE)

(73) Assignee: Federal Mogul Sealing Systems Bretten GmbH, Bretten (DE)

( * ) Notice: Subject to any disclaimer, the term of this patent is extended or adjusted under 35 U.S.C. 154(b) by 0 days.

(21) Appl. No.: 12/273,145

(22) Filed: Nov. 18, 2008

(65) Prior Publication Data

US 2009/0065976 A1 Mar. 12, 2009

Related U.S. Application Data

(62) Division of application No. 11/181,142, filed on Jul. 14, 2005.

(30) Foreign Application Priority Data

Jul. 15, 2004 (DE) ..... 10 2004 034 235

(51) Int. Cl.
*B28B 5/00* (2006.01)

(52) U.S. Cl. ..... 264/241; 123/195 C; 123/198 E

(58) Field of Classification Search ..... 123/90.37, 123/90.38, 195 C, 198 E; 267/241; 521/170; 264/241

See application file for complete search history.

(56) References Cited

U.S. PATENT DOCUMENTS

| | | | | |
|---|---|---|---|---|
| 3,519,279 | A | 7/1970 | Wagner | |
| 3,655,727 | A * | 4/1972 | Patel et al. | 525/326.3 |
| 4,819,953 | A | 4/1989 | Joh | |
| 4,867,461 | A | 9/1989 | Shimmell | |
| 5,375,569 | A | 12/1994 | Santella | |
| 5,513,603 | A * | 5/1996 | Ang et al. | 123/90.37 |
| 5,957,100 | A * | 9/1999 | Frohwerk et al. | 123/90.38 |
| 6,224,058 | B1 | 5/2001 | Drebing et al. | |
| 6,511,075 | B1 | 1/2003 | Schmidt | |
| 6,579,487 | B1 * | 6/2003 | Lichtinger | 264/255 |
| 6,827,353 | B2 | 12/2004 | Fonville et al. | |
| 6,849,667 | B2 * | 2/2005 | Haseyama et al. | 521/170 |
| 6,896,098 | B2 | 5/2005 | Vom Stein et al. | |

FOREIGN PATENT DOCUMENTS

| | | | |
|---|---|---|---|
| DE | 3602705 | A1 | 9/1986 |
| DE | 3819336 | A1 | 12/1988 |
| DE | 4343586 | A1 | 6/1995 |
| DE | 4202860 | C2 | 8/1995 |
| DE | 19641904 | A1 | 4/1998 |
| DE | 19718504 | A1 | 11/1998 |
| DE | 19738275 | A1 | 3/1999 |

(Continued)

*Primary Examiner*—Stephen K Cronin
*Assistant Examiner*—J. Page Hufty
(74) *Attorney, Agent, or Firm*—Robert L. Stearns; Dickinson Wright, PLLC

(57) ABSTRACT

A lid component part of an internal combustion engine with integrated elastic seal, such as, for example, is provided to a cylinder head gasket or oil pan and a process for its manufacture. The component part exhibits a circumferential flange area for the arranging of the integrated seal. The component part is based on a plastic-material, while the seal essentially comprises an organic elastomer material. The component part and the seal are chemically bonded with one another. The seal is applied by injection molding onto the component part.

3 Claims, 2 Drawing Sheets

FOREIGN PATENT DOCUMENTS

Figure 1:
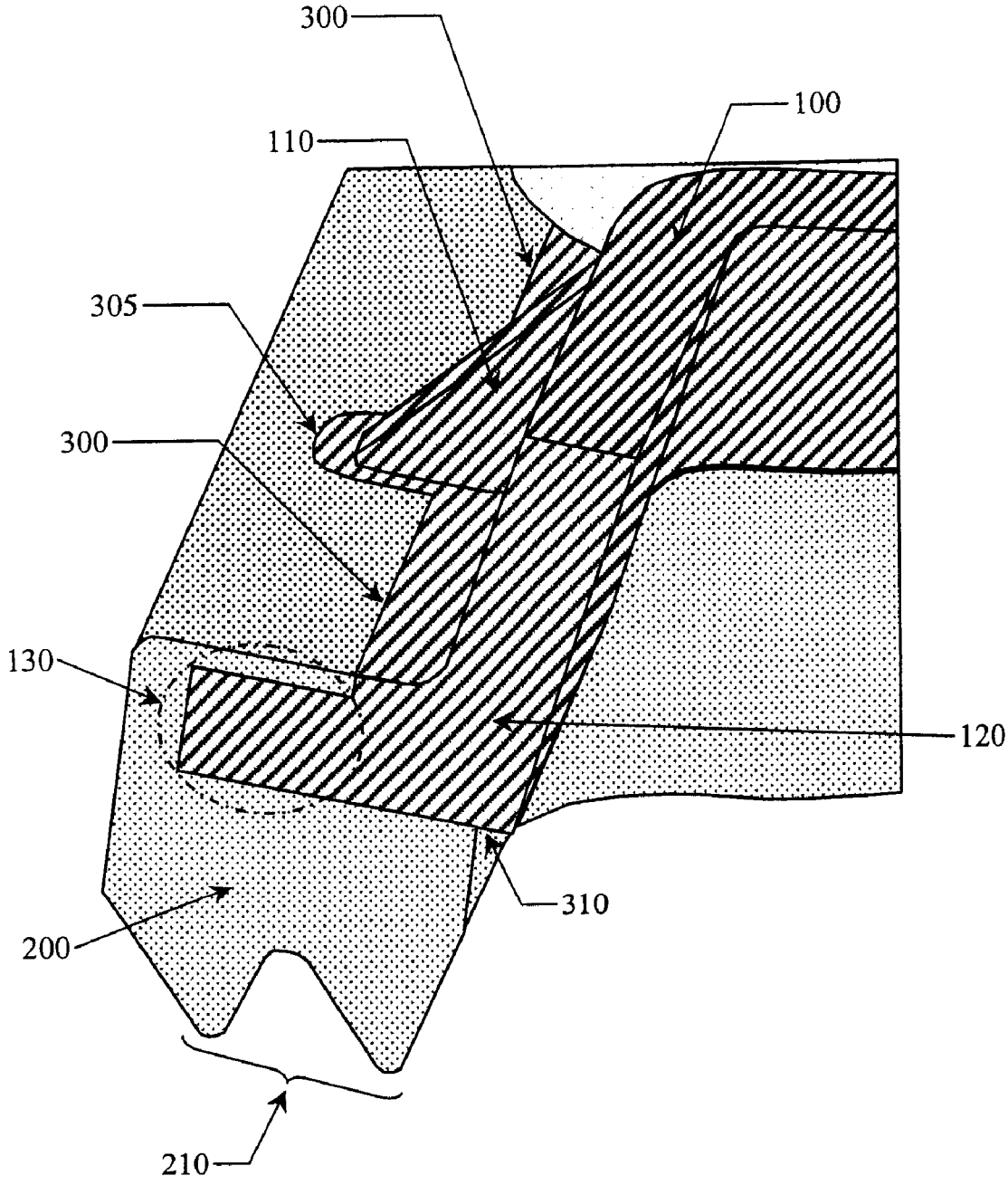

| | | | |
|---|---|---|---|
| DE | 19743134 | A1 | 4/1999 |
| DE | 10119892 | A1 | 11/2002 |
| DE | 10217522 | A1 | 11/2003 |
| EP | 1234851 | A1 | 8/2002 |
| GB | 1263077 | | 2/1972 |

* cited by examiner

COMPONENT PART WITH INTEGRATED SEAL

This is a divisional application which claims priority to German Patent Application No. 10 2004 034 235.0, filed Jul. 15, 2004 and U.S. patent application Ser. No. 11/181,142, filed Jul. 14, 2005.

BACKGROUND OF THE INVENTION

1. Technical Field

The present invention relates to an elastic seal for static sealing plastic components in the field of internal combustion engines, for example, cylinder head gaskets made from plastic. In particular, the present invention concerns an integrated seal with a component part of this type.

2. Related Art

Thin-walled lids for internal combustion engines, such as, for example, valve covers or cylinder head gaskets include elastic seals for static sealing. The known seals are, as a rule, buttoned-in or vulcanized directly at the cylinder head gasket. With the vulcanized seals, the elastomer either is injected into an available groove and mechanically clamped (DE 42 02 860) or clamped in closed form (DE 197 38 275) or joined by an adhesive to the surface (GB 12 63 077).

In the field of internal combustion engines there is, however, an increasing need at present for seals which are joined firmly with sealing component parts. Integrated seals of this kind have the advantage, that larger system components can be delivered prefabricated in a so-called module. The joining or, respectively, integration of seal and component part and lid demonstrates strong technical advantages such as the form stability of the seal, advantageous handling during production and assembly, etc. Typical component parts, to which the seals are directly injection molded in order to achieve joining of component parts and seals, mainly comprise component parts such as, for example, cylinder head gaskets or oil pans made from die-cast metal or steel sheets. For directly injection-molded seals of this kind, an adhesive agent is conventionally used which brings about the necessary binding between metal die-cast or (steel-) sheet) and seal.

SUMMARY OF THE INVENTION AND ADVANTAGES

Component parts made from plastic, which are distinguished, above all, by their lower density, replace to an increasing degree their counterparts of metal provided that a weight reduction is obtained, which directly favorably affects the fuel consumption of the internal combustion engine. Up to now, directly injected seals of this type of plastic component parts of internal combustion engines are not in use.

It is an object of the invention to provide a component part made of plastic with a directly injection-molded seal. In particular, it is an object of the invention to provide a cylinder head gasket made from plastic with directly injection molded and integrated seal.

The problem is solved according to the present invention by providing a lid component part of an internal combustion machine with integrated elastic seal, as for example, a cylinder head gasket or oil pan. The component part has a circular flange area for structuring the integrated seal. The component part is based on a plastic material, while the seal is formed substantially from an organic elastomer material. The component part and the seal are chemically bound with one another.

In accordance with the invention the flange area is formed substantially in an L-shape, so that the seal is arranged with its sealing profiled element on a seal surface of the flange area. Furthermore, the seal encompasses the lateral flange area, so that the seal is at least partially arranged on the upper flange surface.

Preferably the component part is prepared from polyamide. Advantageously, the elastomer material of the seal has a Mooney-viscosity ML (1+4) at 100° C. in a range of about 20 to 100 and particularly in a range of about 25 to 50. Especially, the organic elastomer material is a rubber such as, for example, a fluorinated rubber or an acrylate rubber. Preferred are organic elastomer materials made from polyacrylate (ACM) or ethylene acrylate (AEM). Advantageously, a crosslinking system of organic elastomers is based on hexamethylenediaminecarbamate or N,N'-di-ortho-tolylguanidine. According to the invention, the chemical binding between the component part and the organic elastomer material of the seal can be effected by an adhesive.

Preferably, the component part is formed of thin-walls.

In accordance with the invention, the flange area can have one or more passages, which are filled with the organic elastomer materials of the seal, so that a part of the seal arranged on the seal surface is capable of mechanically coupling with a part of the seal arranged on the upper flange surface. Furthermore, according to the invention the component part has one or more blocking structures, which are encompassed by the seal.

Preferably, the seal is applied by means of injection molding on the component part.

In accordance with the invention, a method is provided in order for a lid component part with integrated elastic seal of an internal combustion engine to be manufactured, such as for example, a cylinder head gasket or oil pan. The component part with a circular flange area for disposition of the seal is provided and the seal made from an organic elastomer material is applied by means of a pick tool. The component part and the seal undergo a chemical bonding with one another.

Preferably, the pick tool is so formed that the resulting seal with its seal gasket is arranged on a seal flange of the surface area, and encompasses the lateral flange area, so that the seal is at least partially arranged on the upper flange surface. For this, the flange area is formed substantially in L-shape. Furthermore, the component part can be provided preheated at a temperature in a range from about 100° C. to 150° C.

THE DRAWINGS

Figure 2:
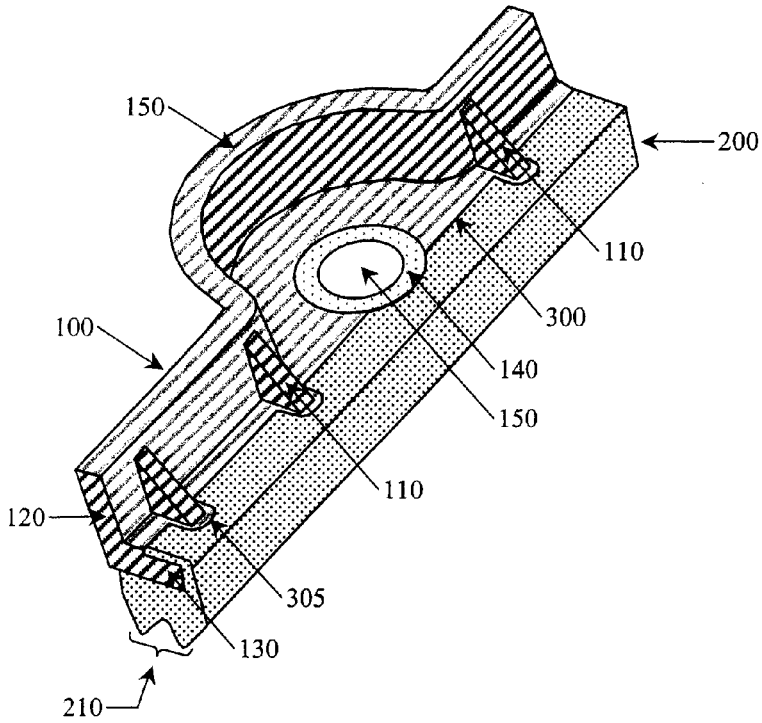
Figure 3:
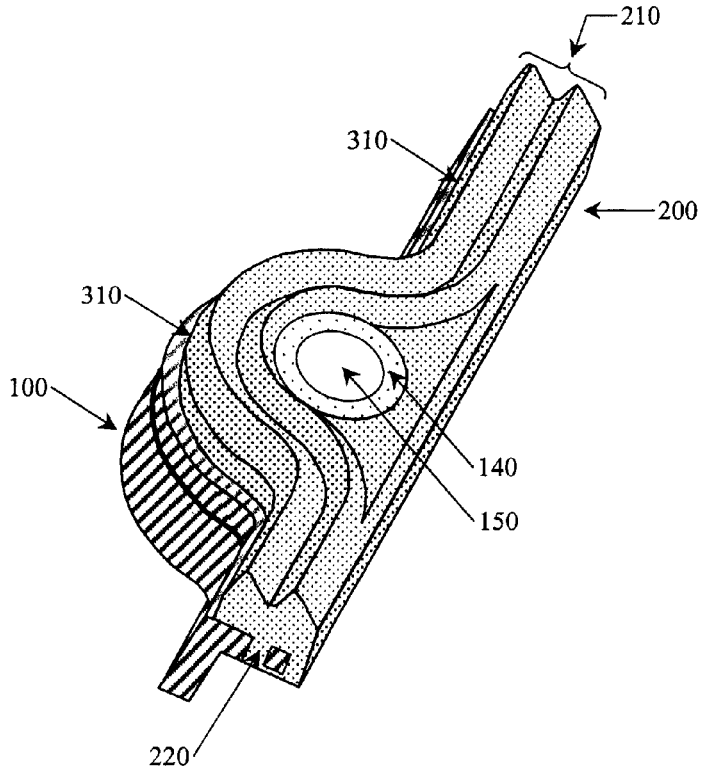

The invention is explained in more detail by means of the following exemplary drawings which refer to a specific embodiment of the invention. The drawings show:

FIG. 1 a first schematic perspective sectional view of a component part with integrated seal according to a specific embodiment of the invention;

FIG. 2 a second schematic perspective sectional view of the component part according to FIG. 1 with screw connection point; and FIG. 3 a third schematic perspective sectional view of the component part according to FIGS. 1 and 2 with screw connection point and aspect on the seal gasket.

DETAILED DESCRIPTION

In the figures, as well as in the description, the same reference numerals are used, in order to designate the same or similar component parts or elements.

With reference to FIG. 1 a plastic component part of an internal combustion engine with an integrated seal according to a specific embodiment of the invention is explained by example. The shown component part frame of FIG. 1 could be a lid, a cylinder head gasket, an oil pan or the like. The component part provided with integrated seal is designated in general as 100 in the figures, while the injection molded seal, which in this embodiment is set out by example as a double-lipped seal, is designated as 200 in the figures. The sealing profiled element of the double-lip seal is named as 210 in the figures.

Of course, sealing profile elements with a single seal lip or several seal lips are possible.

The component part 100, that is exemplary of the lid, the cylinder head gasket, the oil pan, etc. is made as described above from plastic, preferably made from polyamide. Elastomers are used as sealing substances, especially preferred are selected organic elastomers but not conventional inorganic elastomers such as, for example, silicone. Out of the field of the organic elastomers, above all, rubbers such as, for example, fluorinated rubber (FPM), acrylate-rubber, polyacrylate-acrylic resin, polyacrylate (ACM) ethylene acrylate (AEM) are used. For the injection process, among other things, the viscosity of the used organic elastomers and particularly the Mooney-viscosity, that is, a measure of the sheer viscosity, is to be considered. According to material choice and Shore A hardness the Mooney-viscosity ML (1+4) of the organic elastomers, measured at 100° C., cost-effectively should be in a range from about 20 to 100. In order to ensure that a chemical bonding between the plastic component parts and the injected seal made from AEM or ACM is obtained, the Mooney-viscosity (ML (1+4) at 100° C.) should be in the range of about 25 to 50 in accordance with this material choice.

The bonding of the plastic component parts and seal made from elastomer can result through direct adhesion joining together of the materials or with the aid of an additionally supplied adhesive. Alternatively, the plastic of the component part and/or the elastomer can be modified, in order to enable the adhesion, in the form for example, of a chemical bond.

Moreover, for a chemical bond between component part and injection-molded seal, preferably a suitable crosslinking system of the elastomers is to be chosen, which forms chemically compatible and suitable chemical bonding. For a component part made from polyamide the crosslinking system would be composed on the basis of hexamethylene diamine carbamate and N,N'-Di-ortho-tolylguanidine, in order to insure the chemical bonding of the polyamide with the elastomer.

A good chemical bond between the plastic component part and the injection-molded seal is additionally guaranteed preferably by preheating of the component part. Conveniently, the component part is heated to a temperature in the range of about 100° C. to 150° C. before the injection of the seal, that is, before the injection process.

In conclusion, it is to be noted that the combination of plastic of the component part and elastomer of the seal, which is provided for integration with the component part, has to fulfill the requirements of the use environment. That is, the requirements among others, are decisive for the selection of the material and/or elastomers. In particular, temperature demands, creep effects of the material (component part materials, seal-materials) and stiffness are to be taken into consideration. The combined effect of the component part with the other component part, against which the sealing should take place or against whose surface the sealing should occur, is also to be considered. Variable physical properties of the materials used for the component parts are of particular interest in this context. Thus, the plastic component part with integrated seal may seal against a component part manufactured from metal, whereby the physical properties particularly in respect to the temperature-contingent varying expansion-properties and varying rigidity properties, are to be taken into consideration.

In combination with the above-described chemical bonding of the injection-molded seal based upon an organic elastomer to the component part made from plastic, an advantageous novel geometry of the component part with integrated seal is proposed within the scope of the present invention. The novel geometry concerns the flange area of the component part, at which the integrated seal is arranged. With reference to FIG. 1 in the perspective sectional view, a cross-sectional surface 120 of the component part is shown. The flange area of the component part is formed with a generally L-shaped projection towards periphery, i.e. the flange surface is generally L-shaped. The projection is designated in general as 130 in the figures.

The flange area has a lower flange surface, also designated in the following as a sealing profile surface, which in the assembled state of the component part is directed to a seal opposite surface of an opposite or counter component part (not shown) and an upper flange surface which is arranged parallel to the lower surface and is directed in the assembled state away from the seal opposite surface of the opposite or counter component part.

The seal is wrapped around the flange area. This means that the seal, whose seal element profile is arranged on the seal element profile surface, laterally encompasses towards periphery the L-shaped protrusion of the flange area, so that a lateral flange surface of the L-shaped protrusion of the flange area of the seal is covered, and is arranged at least partially overlapping the upper flange surface of the L-shaped protrusion of the flange area. On the upper flange surface a sealing-off edge 300 is provided, up to which the elastomer-material of the seal is disposed and with which the seal preferably terminates flatly upwards there. Furthermore, the seal also has a sealing edge 310, on which the arranged sealing element profile extends.

The seal laterally encompassing the flange area also has the advantage, that the seal and the seal element profile can be arranged more closely to the lateral edge of the component part, respectively, so that the flange area can be better utilized. This is not the case, if the seal had been completely arranged on the sealing element profile surface or, respectively, on the lower flange surface and had been imprinted there accordingly on both sides. In the proposed geometry of the invention, the seal is only one-sided, and the lateral opposite edge is imprinted.

The tool or the pointed tool for the deployment of the injected seal with the above-described seal geometry is provided with imprinted areas in correspondence with the sealing-off edge 300 on the upper flange surface and a sealing edge 310 on the lower flange surface or, respectively, the sealing element profile surface. In the imprint areas the tool seals off during the injection processes against the component part, so the seal geometry explained above, which provides an encirclement of the surface area, is obtained.

For mechanical reinforcement of plastic component parts, as discussed herein, additional reinforcement ribs 110 or other reinforcement structures of equal function are often inserted in order to strengthen the flange area of the component part and to ensure and/or to improve the sealing effect of the seal. Exemplarily, a reinforcement rib 110 is illustrated in FIG. 1. The encompassing or encircling seal encompasses the flange or encircles the reinforcement rib 110, which also is encircled by a sealing-off edge 305, which stands in connection with sealing-off edge 300.

The above-explained tool or pointed tool is adjusted in correspondence with the course of the sealing-off edges 300 and 305, in order to enable the above explained encirclement of the reinforcement ribs 110 and the reinforcement structures by means of the seal geometry, respectively.

FIG. 2 shows a second schematic perspective sectional view of the component part corresponding to the specific embodiment illustrated in FIG. 1. The sectional view shown in FIG. 2 illustrates essentially a top view on the upper flange surface and a specified screw point 150 in the component part to this assembly.

For exemplary illustration the component part with three reinforcement ribs 110 is provided, which shows in each case a sealing-off edge (305) adapted to the geometry of the reinforcement ribs 110 and encompassed by the seal as described above.

The screwing point 150 shows exemplarily a possibility, to provide an eye area or an implementation, by means of which the component part can be fastened to the counter component part. Advantageously, the screwing point 150 serves for passing through a screw which is screwed into the counter component part, in order to fix the component part with the sealing element profile of the seal to be fixed against the counter component part. For the fixation, a predetermined jacking force is usually set. For mechanical stabilization and/or reinforcement, such a screwing point 150 can be provided with a reinforcement 140 such as, for example, a hollow shaft, which preferably can be manufactured from a plastic or metal material. Such grommets or screwing points 150 are advantageously arranged substantially in the flange area, so that the predetermined jacking force, which is exerted by the fixation of the component part by means of the screwing points 150, directly on the seal or the sealing element profile, as much as possible.

In addition, with implementations of this kind (or, respectively, screwing points 150) decoupling elements for acoustic decoupling of the component part of the counter component part and/or separator can be provided. The decoupling elements and the separator, respectively, can be injected together with the seal or be formed from one other material with contingent differing Shore A hardness. The decoupling element and the separator can subsequently also be provided integrated.

In conclusion, FIG. 3 shows a third schematic perspective sectional view of the component part corresponding to the specific embodiment illustrated in FIG. 1 or 2.

The sectional view displayed in FIG. 3 shows in essence a top view on the sealing element profile, i.e. the lower flange surface, and the screwing point 150 with hollow shaft 140.

In the perspective sectional view of FIG. 3 the double-lipped profile of the seal is clearly recognizable. The seal is led around the screwing point 150 with hollow shaft 140. The seal is passed around as seal lips at sufficient distance. However, alternatively it is also possible, at points of constriction, particularly in the area of screwing points, such as the screwing point 150 to bring together the sealing element profile in the form of double lips, so that at least area-wise the sealing element profile is implemented as single lip. Equivalents are also certainly valid for multi-lipped embodiments of the sealing element profile, which can be brought together to a reduced number of double-lips at constriction points.

Advantageously, the flange surface is provided with additional passages 220. Such passages can be filled, for example, during the injection process for the disposition of the seal with the elastomer, so that an immediate coupling of the applied seal on the upper flange surface and the applied seal on the lower flange surface is obtained, which effects a stabilization of the seal geometry supplementary to the bonding of seal and component part. Alternatively, a mechanical fixation of the seal in the above-described action can also be obtained by means of an additional fixation element, which intervenes in the passages 220 or passes through the passages 220.

The invention claimed is:

1. A process for manufacturing of a lid component part of an internal combustion engine with integrated elastic seal, comprising:

providing of the component part with a circumferential flange area for the arranging of the seal, wherein said component part is made of polyamide, providing an organic elastomeric material with a crosslinking system, which is based on hexamethylene diamine carbamate and N,N'-Di-ortho-tolylguanidine;

injecting said organic elastomeric material of said integrated elastic seal by a pointed tool on said circumferential flange area of said component part; and upon injecting, forming said integrated elastic seal from said organic elastomeric material and forming a chemical bonding directly between said component part and said seal by the help of said crosslinking system and without the assistance of an adhesive.

2. The process according to claim 1, wherein said pointed tool is constructed so that said resulting seal is arranged with a sealing element profile on a sealing surface of said flange area and laterally intervenes said flange area so that said seal is at least partially arranged on said upper flange surface, wherein said flange region is formed essentially L-shaped.

3. The process according to claim 1, wherein said component part is preheated to a temperature in a range from about 100° C. to 150° C.

* * * * *